US006419205B1

(12) United States Patent
Meendering

(10) Patent No.: US 6,419,205 B1
(45) **Date of Patent: *Jul. 16, 2002**

(54) CORNER BRACKET FOR CONCRETE POURING FORMS

(76) Inventor: Allen Meendering, P.O. Box 488, Tea, SD (US) 57064

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,177

(22) Filed: Dec. 22, 1998

(51) Int. Cl.[7] ..... E04G 17/14
(52) U.S. Cl. ..... 249/210; 249/194
(58) Field of Search ..... 249/27, 194, 192, 249/47, 210; 52/241, 274

(56) References Cited

U.S. PATENT DOCUMENTS

| | | | | | |
|---|---|---|---|---|---|
| 2,763,048 | A | * | 9/1956 | Sullivan | 249/194 |
| 3,611,664 | A | | 10/1971 | Barbera | |
| 3,662,985 | A | * | 5/1972 | Parker | 249/194 |
| 3,772,842 | A | | 11/1973 | Barbera | |
| 3,852,926 | A | * | 12/1974 | Papsco | 52/241 |
| 4,889,310 | A | | 12/1989 | Boeshart | |
| 4,916,879 | A | | 4/1990 | Boeshart | |
| 5,040,344 | A | | 8/1991 | Durand | |
| 5,209,039 | A | | 5/1993 | Boeshart | |
| 5,222,335 | A | * | 6/1993 | Petrecca | 52/241 |
| 5,611,182 | A | | 3/1997 | Spude | |
| 5,649,401 | A | | 7/1997 | Harrington, Jr. | |
| 5,658,483 | A | * | 8/1997 | Boeshart | 249/194 |
| 5,992,114 | A | | 11/1999 | Zelinsky et al. | |
| 6,293,067 | B1 | * | 9/2001 | Meendering | 52/426 |

* cited by examiner

*Primary Examiner*—Michael Safavi
(74) *Attorney, Agent, or Firm*—Brian J. Laurenzo; Michael C. Gilchrist

(57) ABSTRACT

A bracket for use with a system of forms for holding poured concrete forming concrete walls. The bracket is used to hold the forms at corners of the system when the concrete walls change directions. The corner bracket includes formations to hold the wall panels in place at the corner.

3 Claims, 1 Drawing Sheet

CORNER BRACKET FOR CONCRETE POURING FORMS

BACKGROUND AND SUMMARY OF THE INVENTION

This invention pertains to systems of spaced apart walls providing space into which concrete can be poured to form a concrete wall. Such systems are shown and fully described in applicant's co-pending application Serial #09/040,659, filed Mar. 17, 1998. Briefly those forms include panels held together by H-shaped tracks to assemble walls for the forms. The walls are then held in substantially parallel relationships by some form of tie member engaged between the parallel walls. These ties are frequently associated with the tracks that hold the panels.

Such systems work well for straight walls. At corners, however, there are frequently problems. Corners in this sense are commonly right angle intersections, but may be less or more than a 90 degree intersection. Further, a corner for the purpose of this application may be a rounded corner as well as a sharp angular intersection.

At such corner, it is fairly common for the panels of plastic forming the wall section to be pulled apart, thus separating the panel from the rails. This is particularly true of the outer wall at the corner, though the inner wall, too, may separate.

By this invention, a rail combination forming the corner of the wall is formed with gripping parts which have a strong tendency to hold the panel piece in the rail and therefore to prevent separation at the corners.

DESCRIPTION

Briefly this invention comprises a pair of rails, joined at an intersection to hold formed plastic panels in a corner formation. The panels are used to hold concrete being poured to form a wall. The corner sections are formed to provide ribs substantially perpendicular to the line of the wall being poured so that the panels will be held in place in the rail as the pouring process proceeds.

Figure 1:
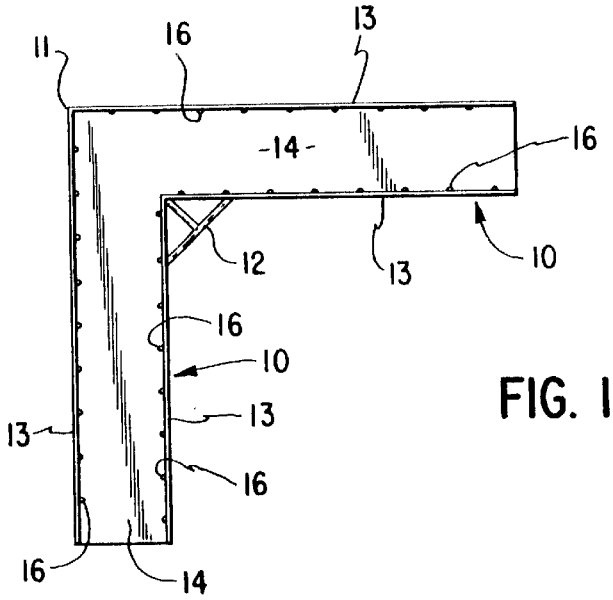
FIG. 1 is a top plan view of the corner rail piece.
Figure 2:
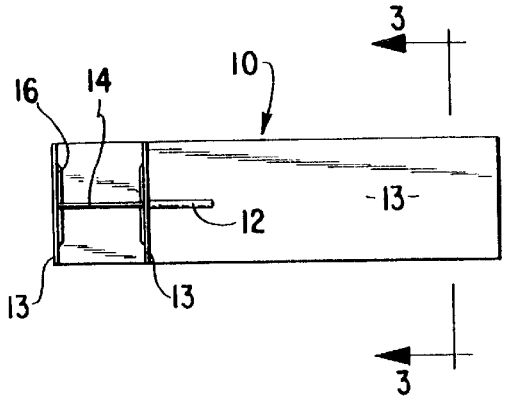
FIG. 2 in an elevational view of the rail piece shown in FIG. 1.
Figure 3:
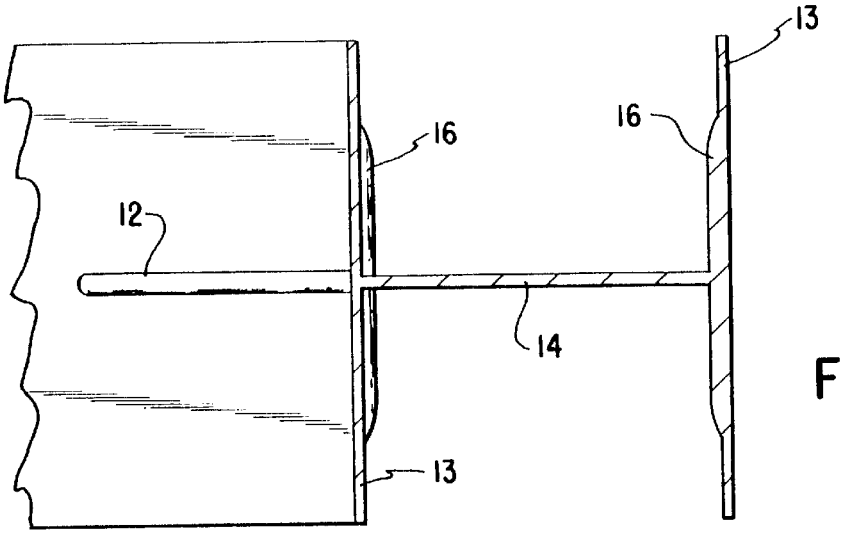
FIG. 3 in a sectional view from line 3—3 of FIG. 2 and to an enlarged scale.

More specifically and referring to the drawings, the corner bracket is formed of two rails 10 intersecting at a corner 11. A brace 12 may be used to reinforce the corner. This brace may also be used as a material injection point. As described in the co-pending application noted herein before, and as shown on FIG. 3, each rail is composed of a pair of flanges 13 joined together by a web 14 forming an H-shape—or in case of a top or bottom rail—a U-shape.

Although the bracket is illustrated as being for a right-angle corner, it will be obvious that for odd-shaped (triangular, hexagonal, octagonal) enclosures, or for offsets at other than a right angle, other brackets might be built using proper angles for such other shapes. If panels can be formed to fit a rounded corner, even that shape could be built into the corner bracket.

The particularly unique factor of the bracket is the mechanism used to prevent the sliding of a panel out of the bracket. On the inside wall of each flange 13 are a series of ridges 16 disposed nearly perpendicular to the web 14. These ridges must be pressed into the side of the panel forming the wall as the form is assembled. They then form pairs of mating tongues on the flanges 13 and groove formations pressed into the material of the panel which resist any sliding of the panel relative to the bracket. This resistance is ordinarily adequate to hold the panel in place in the bracket.

The use of multiple ridges is generally required because the ridge must not be so high that assembly of the panel becomes difficult. Thus by using a plurality of smaller ridges, the same effect as a higher ridge can be achieved. It will be seen that in order to be effective, each bracket rail must be of sufficient length to allow for the plurality of ridges. Experience has shown that five or six or more ridges spaced apart approximately a half to three quarters of the width of the web may be the minimum required in order to be effective.

It is apparent that the invention makes feasible the use of a built up form for the pouring of concrete by holding the form together at its corners as well as along the straight part of the wall.

What is claimed is:

1. A corner bracket for use in holding panels of a concrete form, the corner bracket comprising:

a first rail having a free end and a corner end, said first rail having a first rail outer flange, a first rail inner flange, and a first rail web, said first rail inner and outer flanges being parallel to each other, and said first rail web spanning between said first rail inner and outer flanges and being perpendicular to said first rail inner and outer flanges to form a first channel;

a first plurality of elongated ridges formed on said first rail inner flange and extending into said first channel, each of said ridges in said first plurality of elongated ridges being substantially perpendicular to a line formed by an intersection between said first rail web and said first rail inner flange;

a second rail having a free end and a corner end, said second rail having a second rail outer flange, a second rail inner flange, and a second rail web, said second rail inner and outer flanges being parallel to each other, and said second rail web spanning between said second rail inner and outer flanges and being perpendicular to said second rail inner and outer flanges to form a second channel, said first and second rails being connected to each other at their corner ends at an angle with respect to each other; and a second plurality of elongated ridges formed on said second rail inner flange and extending into said second channel, each of said ridges in said second plurality of ridges being substantially perpendicular to a line formed by an intersection between said second rail web and said second rail inner flange.

2. The corner bracket according to claim 1, further comprising:

a third plurality of elongated ridges formed on said first rail outer flange and extending into said first channel, each of said ridges in said third plurality of elongated ridges being substantially perpendicular to a line formed by an intersection between said first rail web and said first rail outer flange; and a fourth plurality of elongated ridges formed on said second rail outer flange and extending into said second channel, each of said ridges in said fourth plurality of ridges being substantially perpendicular to a line formed by an intersection between said second rail web and said second rail outer flange.

3. The corner bracket according to claim 2 further comprising a brace extending between said first rail inner flange and said second rail inner flange to hold said first and second rails in a fixed angular orientation relative to each other.

* * * * *